US008857227B2

(12) United States Patent
Chupka

(10) Patent No.: US 8,857,227 B2
(45) Date of Patent: Oct. 14, 2014

(54) STATUS SENSOR FOR A CLUTCH ON A WASHING MACHINE APPLIANCE

(75) Inventor: Edward Simeon Chupka, Bardstown, KY (US)

(73) Assignee: General Electric Company, Schenectady, NY (US)

( * ) Notice: Subject to any disclaimer, the term of this patent is extended or adjusted under 35 U.S.C. 154(b) by 163 days.

(21) Appl. No.: 13/372,021

(22) Filed: Feb. 13, 2012

(65) Prior Publication Data

US 2013/0205512 A1 Aug. 15, 2013

(51) Int. Cl.
*D06F 21/00* (2006.01)

(52) U.S. Cl.
USPC ..... 68/140

(58) Field of Classification Search
CPC ..... D06F 37/40
USPC ..... 68/12.24, 12.25, 12.27, 23.6, 23.7, 24, 68/140
See application file for complete search history.

(56) References Cited

U.S. PATENT DOCUMENTS

| | | | | |
|---|---|---|---|---|
| 2,468,919 | A * | 5/1949 | Brotman | 74/1 R |
| 5,017,747 | A * | 5/1991 | Nagahara et al. | 200/453 |
| 5,887,458 | A | 3/1999 | Bae | |
| 6,176,108 | B1 | 1/2001 | Bae et al. | |
| 6,332,343 | B1 * | 12/2001 | Koketsu et al. | 68/23.7 |
| 7,171,715 | B2 | 2/2007 | Yoon et al. | |
| 7,409,737 | B2 | 8/2008 | Cho et al. | |
| 7,418,841 | B2 | 9/2008 | Yoon et al. | |
| 7,543,464 | B2 | 6/2009 | Choi et al. | |

* cited by examiner

*Primary Examiner* — David Cormier
(74) *Attorney, Agent, or Firm* — Dority & Manning

(57) ABSTRACT

A sensor for determining the mode or cycle of a washing machine appliance is provided. The sensor detects the position of a clutch mechanism that is used to shift a wash basket between a spin mode and a wash or rinse mode. The sensor can provide a signal to a controller of the appliance to identify the position of the clutch.

15 Claims, 5 Drawing Sheets

STATUS SENSOR FOR A CLUTCH ON A WASHING MACHINE APPLIANCE

FIELD OF THE INVENTION

The subject matter of the present invention relates generally to the detection of the position of a clutch in a washing machine appliance that is used to shift between different modes of operation.

BACKGROUND OF THE INVENTION

Washing machines are typically equipped to operate with one or more modes or cycles such as wash, rinse, and spin modes. During a wash or rinse mode for a vertical axis washing machine, an agitator is used to impart motion to the laundry articles that are contained within a wash basket. The laundry articles are usually submerged at least partially within a wash or rinse fluid. A wash tub contains the fluid, agitator, and wash basket. During a wash or rinse mode, the wash basket remains stationary while the agitator rotates to impart movement to the laundry articles.

During a spin mode, the wash basket is rotated so as to subject the articles in the laundry to centrifugal forces. These forces cause water and other fluids to be wrung from the clothes. These liquids can exit the wash basket through holes positioned along the outer wall of the wash basket for subsequent removal from the wash tub.

For operation of the washing machine appliance between the wash, rinse, and spin modes, it is desirable to independently control the movement of the agitator and wash basket. More specifically, during the wash and rinse modes the wash basket may be held stationary while the agitator is rotated to impart movement to the laundry articles. During the spin mode, however, rotation of the wash basket is required to wring liquid from the articles as set forth above.

In order to control the rotation of the agitator and wash basket, a vertical axis washing machine can be equipped with e.g., a clutch mechanism for engaging and disengaging the wash basket from a motor that can be used to rotate the wash basket and/or agitator. Of course, determining the desired mode or cycle of the washing machine appliance depends on proper operation of the clutch mechanism. For example, if the clutch mechanism does not properly engage or disengage the motor from the wash basket, the appliance will not be able to switch into the proper mode of operation.

Accordingly, a washing machine appliance that can shift between various modes or cycles of operation would be useful. A washing machine that can also detect whether a clutch mechanism has properly engaged the wash basket of the appliance would be beneficial. Such a washing machine that can base such detection directly upon the position of the clutch mechanism would be particularly beneficial.

BRIEF DESCRIPTION OF THE INVENTION

Aspects and advantages of the invention will be set forth in part in the following description, or may be obvious from the description, or may be learned through practice of the invention.

In one exemplary embodiment, the present invention provides a washing machine appliance that includes a wash tub for the receipt of laundry articles and fluid for cleaning. A wash basket is received into the wash tub. The wash basket is configured for retaining the laundry articles. An agitator is positioned in the wash basket. The agitator is configured for imparting motion to the articles within the wash basket. A motor is provided for selectively rotating one or both of the agitators and the wash basket. An agitator drive element is connected to the agitator and driven by the rotation of the motor. A wash basket drive element is connected to the wash basket and configured for selective rotation by the motor. A clutch is configured for shifting movement along the agitator drive element so as to selectively position the clutch between i) an engaged position in which the clutch connects the motor and the wash basket drive element so that both the agitator and the wash basket are rotated by the motor, and ii) a disengaged position in which the clutch disconnects the motor and the wash basket drive element such that the agitator is rotated while the rotation of the wash basket is prevented. A clutch positioner is configured for moving the clutch between the engaged position and the disengaged position. A switch is positioned proximate to the clutch positioner such that the clutch contacts the switch when shifting along the agitator drive element so as to provide a signal indicative of the position of the clutch.

In another exemplary aspect, the present invention provides a method for operating a washing machine. The washing machine has a wash basket and an agitator received into the wash basket. The method includes the steps of shifting a clutch so as to engage a motor with the wash basket and the agitator; operating the motor to cause the agitator and the wash basket to rotate together; reshifting the clutch so as to disengage the motor from rotating the wash basket; and detecting the movement of the clutch using a switch that is activated by physical contact with the switch caused by the movement of the clutch.

A washing machine is provided that includes a wash basket and an agitator positioned within the wash basket. A motor is includes that is constructed with a stator and a rotor. A shaft extends from the motor and connects to the agitator. A spin tube is positioned around the shaft and connected to the wash basket. A clutch is positioned adjacent to the rotor. The clutch is selectively shiftable between i) an engaged position where the rotor is operably connected with the spin tube so as to rotate the wash basket and the agitator when the motor is activated and ii) a disengaged position where the rotor is no longer connected with the spin tube when the motor is activated. A switch is positioned proximate to the clutch. The switch has an actuator that is depressed by the shifting of the clutch between the engaged position and the disengaged position. The switch is configured to provide a signal indicative of the movement of the clutch.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
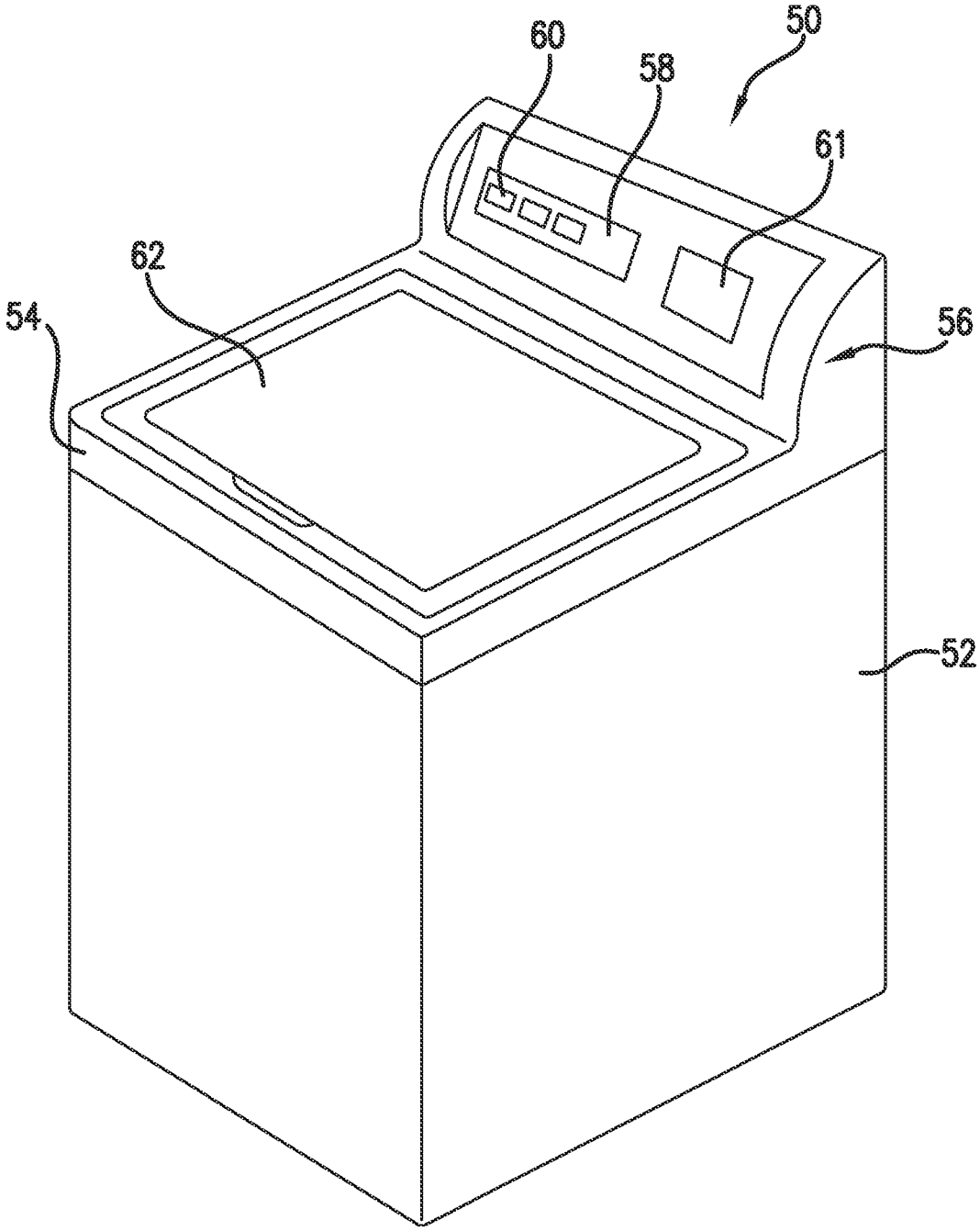
FIG. 1 provides a perspective view of an exemplary embodiment of a washing machine of the present invention.

The present invention provides for determining the mode or cycle of a washing machine appliance. More particularly, the present invention provides a sensor that is used to detect the position of a clutch mechanism that is used to shift a wash basket between a spin mode and a wash or rinse mode. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
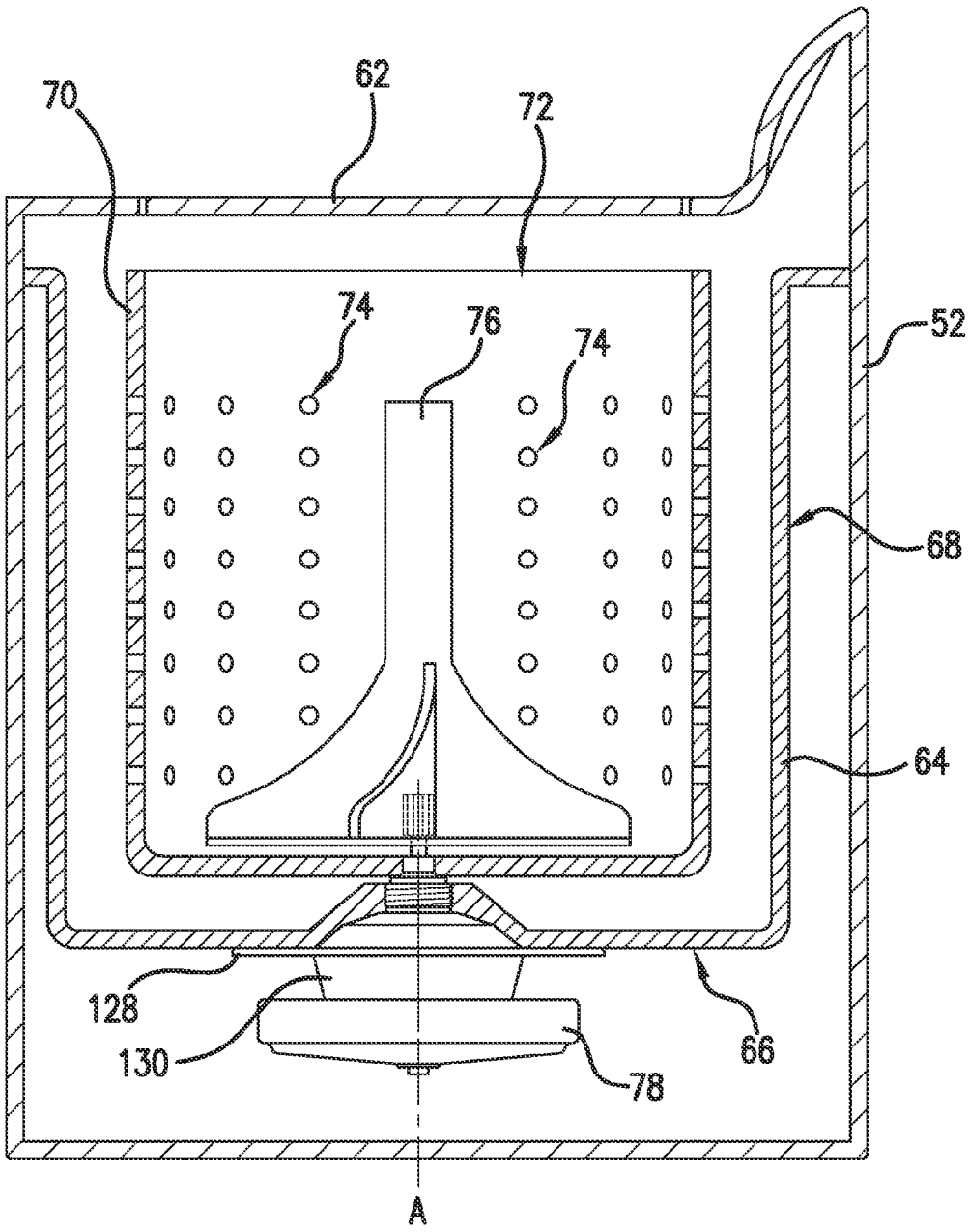
FIG. 2 is a cross-sectional view of the exemplary embodiment of FIG. 1.

FIG. 1 is a perspective view of an exemplary vertical axis washing machine 50 including a cabinet 52 and a top cover 54. FIG. 2 is a side cross-sectional view of the exemplary embodiment of FIG. 1. A backsplash 56 extends from cover 54, and a control panel 58 including a plurality of input selectors 60 is coupled to backsplash 56. Control panel 58 and input selectors 60 collectively form a user interface input for operator selection of machine cycles and features. For example, in one embodiment, a display 61 indicates selected features, a countdown timer, and/or other items of interest to machine users. A door or lid 62 is mounted to cover 54 and is rotatable about a hinge (not shown) between an open position (not shown) facilitating access to wash tub 64 located within cabinet 52, and a closed position (shown in FIG. 1) forming an enclosure over wash tub 64. Wash tub 64 includes a bottom wall 66 and a sidewall 68, and a basket 70 that is rotatably mounted within wash tub 64. A pump assembly (not shown) is located beneath tub 64 and basket 70 for gravity assisted flow when draining tub 64.

Referring now to FIG. 2, wash basket 70 movably disposed and rotatably mounted in wash tub 64 in a spaced apart relationship from tub sidewall 68 and the tub bottom 66. Basket 70 includes an opening 72 for receiving wash fluid and a washload therein. Basket 70 includes a plurality of perforations 74 therein to facilitate fluid communication between an interior of basket 70 and wash tub 64.

An agitation element 76, such as a vane agitator, impeller, auger, or oscillatory basket mechanism, or some combination thereof is disposed in basket 70 to impart an oscillatory motion to articles and liquid in basket 70. In different embodiments, agitation element 76 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 76 is oriented to rotate about a vertical axis A. Basket 70 and agitator 76 are driven by permanent magnet synchronous motor 78, which operates to turn or rotate agitator 76 and/or basket 70 with tub 64 as will be more fully described below.

Operation of machine 50 is controlled by a controller or processing device (not shown) that is operatively coupled to the user interface input 58 located on washing machine backsplash 56 (shown in FIG. 1) for user manipulation to select washing machine cycles and features. In response to user manipulation of the user interface input 58, the controller operates the various components of machine 50 to execute selected machine cycles and features.

In an illustrative embodiment, laundry items are loaded into basket 70, and washing operation is initiated through operator manipulation of control input selectors 60 (shown in FIG. 1). Wash tub 64 is filled with water and mixed with detergent to form a wash fluid. The contents of the basket 70 are agitated with agitation element 76 for cleansing of laundry items in basket 70. More specifically, agitation element 76 is moved back and forth in an oscillatory back and forth motion. In the illustrated embodiment, agitation element 76 is rotated clockwise a specified amount about the vertical axis of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 76 during the strokes imparts mechanical energy to articles in basket 70 for cleansing action. The strokes may be obtained in different embodiments with a reversing motor, a reversible clutch, or other known reciprocating mechanism.

After the agitation phase of the wash cycle is completed, tub 64 is drained with the pump assembly. Laundry items are then rinsed and portions of the cycle repeated, including the agitation phase, depending on the particulars of the wash cycle selected by a user. One or more spin cycles may also be used. In particular, a spin cycle may be applied after the wash cycle and/or after the rinse cycle in order to wring wash fluid from the articles being washed. During a spin cycle, basket 70 is rotated at relatively high speeds. Preferably, basket 70 is held in a fixed position during portions of the wash and rinse cycle while agitator 76 is oscillated as described. During portions of the spin cycle, basket 70 is also rotated to help wring fluid from the laundry articles through holes 74.

Figure 3:
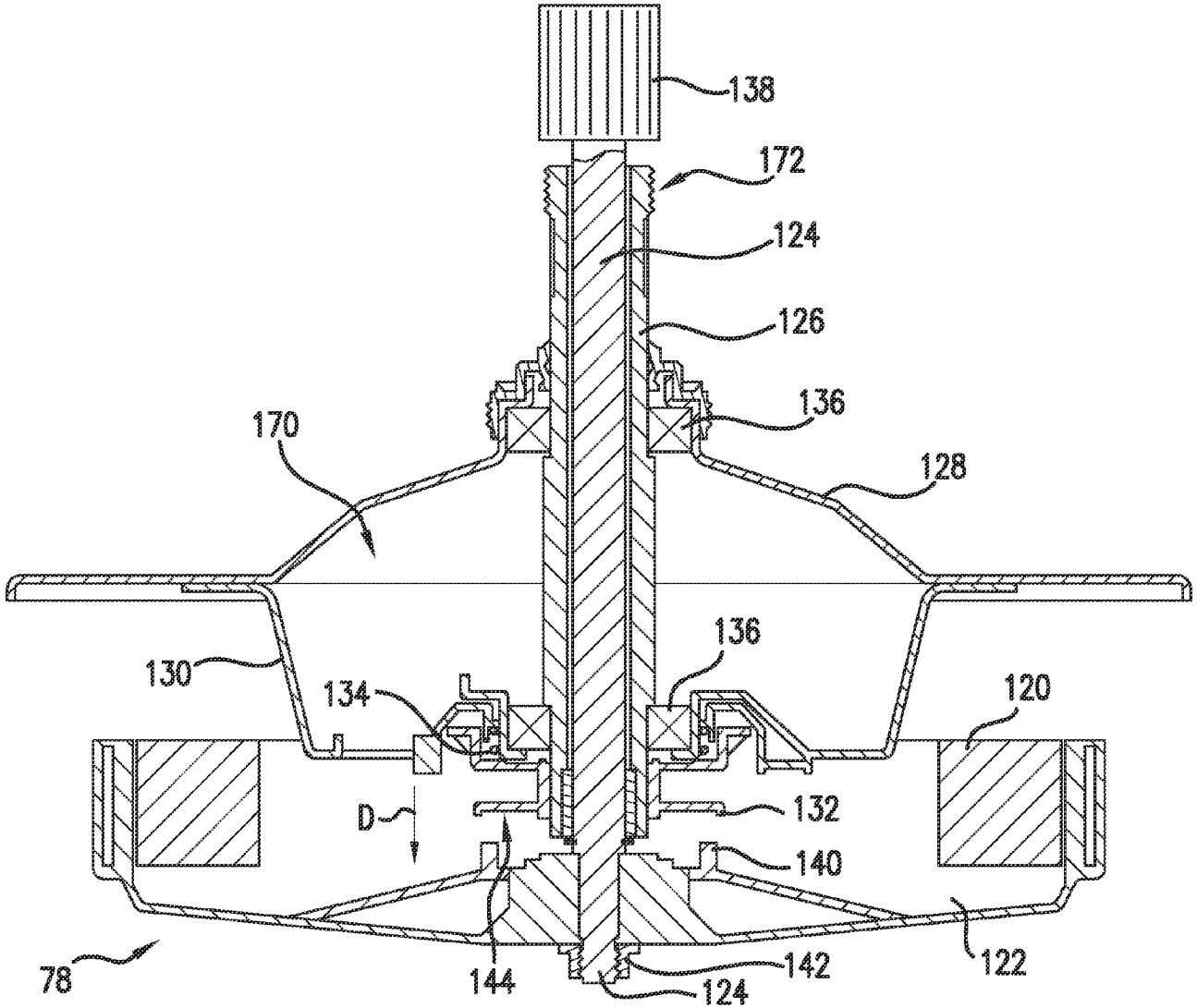
FIG. 3 is a cross-sectional view of an exemplary embodiment of a motor, shaft, and clutch mechanism as may be used in the washing machine of FIGS. 1 and 2.

FIG. 3 provides a cross-section view of motor 78, which includes stator 120 and rotor 122. When energized with the appropriate power, rotor 122 is caused to rotate while stator 120 remains fixed. Rotor 122 is attached to one end of shaft 124 through coupling 142. Shaft 124 extends vertically and is connected with coupling 138 at the end opposite of coupling 142. Coupling 138 attaches shaft 124 to agitator 76.

Stator 120 is attached to lower clam shell 130, which in turn is attached to upper clam shell 128. The bottom wall 66 of wash tub 64 is attached to upper clam shell 128 (FIG. 1). Upper and lower clam shells 128 and 130 collectively form a cavity 170 into which certain are components are received as will be described.

A wash basket drive element or spin tube 126 is concentric with shaft 124. Spin tube 126 is connected with wash basket 70 at threaded end 172. Shaft 124 can rotate with spin tube 126 even if spin tube 126 is held in a fixed position. Spin tube 126 can rotate within upper and lower clam shells 128 and 130, which are mounted on spin tube 126 using bearings 136. Accordingly, the position of spin tube 126 can be fixed to hold wash basket 70 stationary while agitator 76 is oscillated during e.g., a wash or rinse cycle. Alternatively, spin tube 126 and, therefore, wash basket 70 can also be rotated with agitator 76 during a spin cycle.

To selectively control the rotation of wash basket 70, clutch 132 is used to engage and disengage spin tube 126 from rotor 122. In FIG. 3, clutch 132 is shown in an upward position in which spin tube 126 is disengaged from rotor 122 such that the rotation of wash basket 70 is prevented while agitator 76 is rotated (e.g., during wash and rinse cycles). Conversely, if clutch 132 is shifted towards a downward position as indicated by arrow D, clutch face 144 will become engaged with teeth 140 on rotor 122. Clutch spring 134 urges clutch 132 into this position. In this engaged position, spin tube 126 will now rotate with rotor 122 (e.g., during spin cycles).

Figure 4:
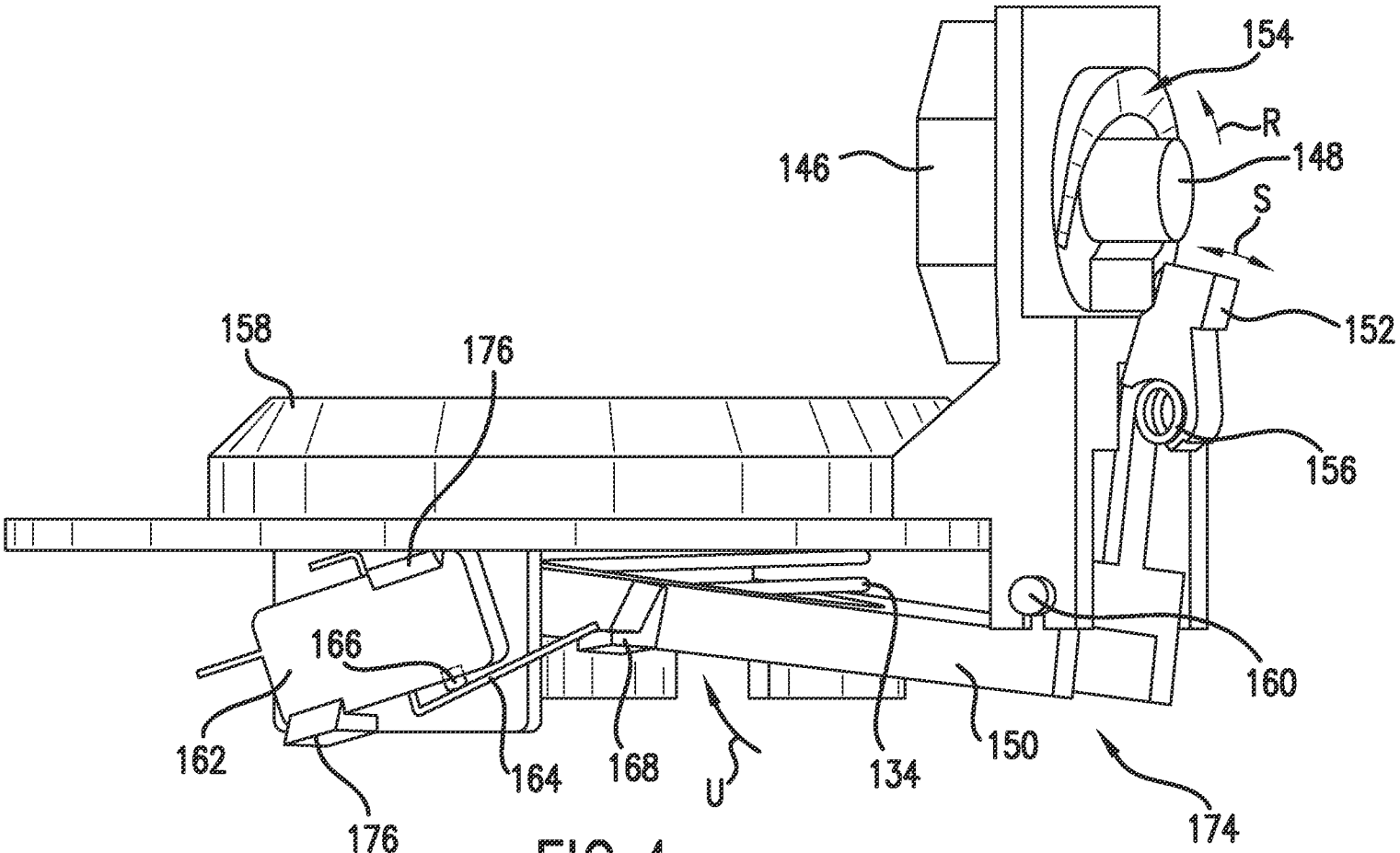
FIGS. 4 and 5 are perspective views of an exemplary embodiment of a clutch and clutch positioning mechanism.
Figure 5:
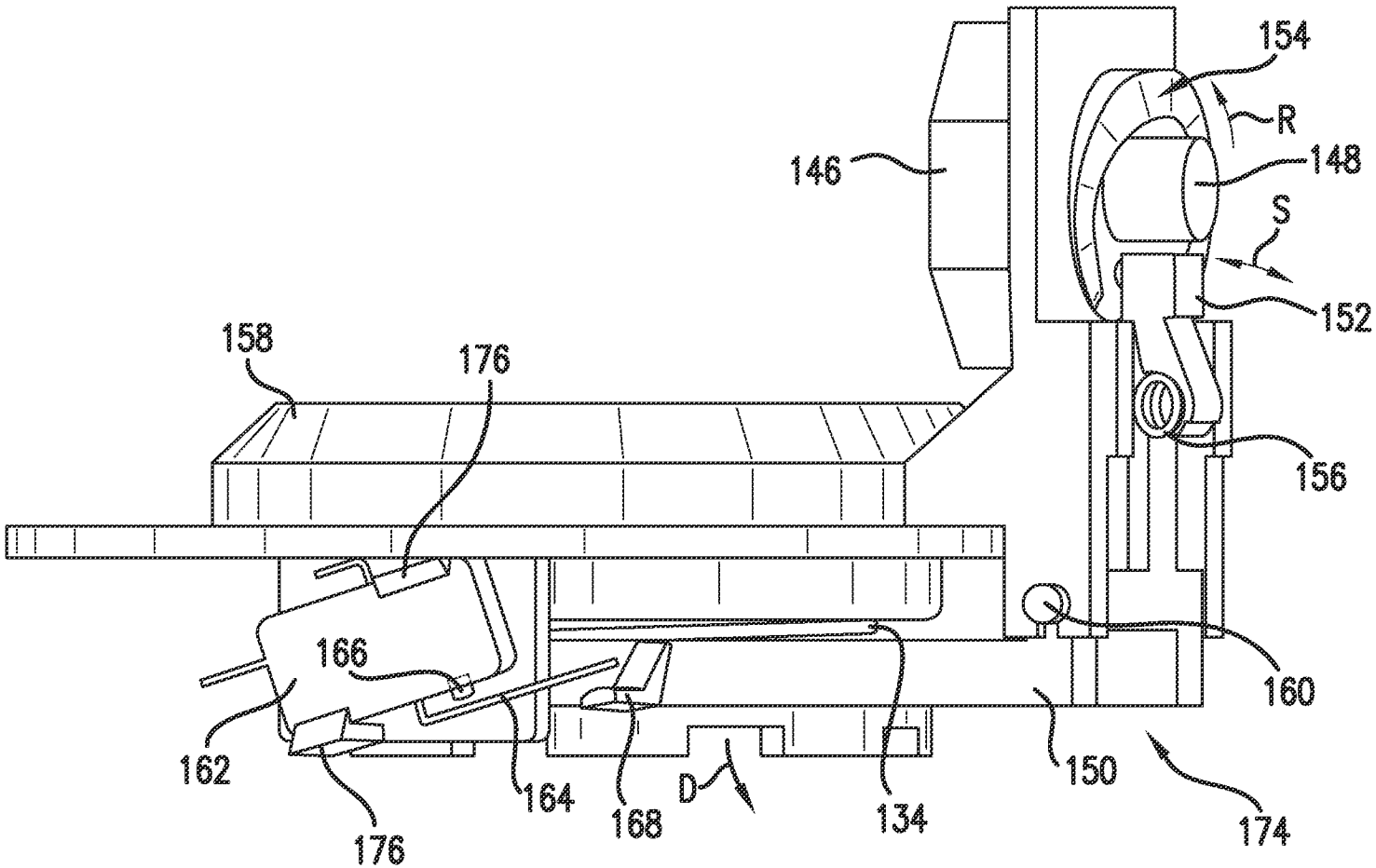

FIGS. 4 and 5 provide exemplary embodiments of a clutch positioning assembly 174 (i.e. mode shifter) of the present invention—at least a portion of which is located within cavity 170. Assembly 174 is used to shift clutch 132 into the engaged and disengaged positions as described to selectively control the mode of operation of wash basket 70 between the spinning mode and non-spinning mode. Assembly 174 is connected with a frame 158, which in tarn is connected with washing machine 50.

As shown, a motor 146 is connected with a cam 148. Motor 146 is used to selectively rotate cam 148 and e.g., can be operably connected with the controller of washing machine 50. Cam 148 includes a curved, inclined surface 154. As motor 146 rotates cam 148 (arrow R), a cam follower 152 rides inclined surface 154, which causes cam follower 152 to shift outwardly or inwardly (arrows S) depending upon the position of cam 148.

Cam follower 152 is connected with a clutch positioner or yoke 150 through torsion spring 156. As cam follower 152 is pushed away from frame 158 by the rotation of cam 148, yoke 150 rotates about pivot point 160 causing yoke 150 to lift upwardly as indicated by arrow U in FIG. 4. Through contact with yoke 150, this upward movement also lifts clutch 132 out of engagement with teeth 140 of rotor 122 (FIG. 3) and, therefore, out of spin mode for wash basket 70. Conversely, as cam follower 152 moves towards frame 158 through rotation of cam 148, yoke 150 moves downwardly as indicated by arrow D in FIG. 5. With the help of clutch spring 134, clutch 132 is lowered and moves downwardly such that teeth 140 engage the rotor 122 and, therefore, wash basket 70 is placed into spin mode.

As previously stated, it is desirable to know whether clutch 132 is in the engaged or disengaged position. While the activation of motor 146 can be used to indicate the rotation of cam 148, such does not necessarily provide positive confirmation that clutch 132 is in the proper position. By way of example, even though cam 148 is rotated, yoke 150 can hang in the up position of FIG. 4 such that clutch 132 is not lowered into spin mode. Simply monitoring motor 146 or the rotation of cam 148 will not reveal this malfunction.

Accordingly, frame 158 is provided with a switch 162 that is mounted using clips 176. Switch 162 includes switch arm 164 that projects towards a finger 168 on frame 158. Switch arm 164 is positioned adjacent to switch actuator 166. When yoke 150 is raised, switch arm 164 makes contact with the actuator 166 to provide a signal to the controller of washing machine 150 indicating that clutch 132 is in the non-spin mode (e.g., wash and/or rinse cycle). When yoke 150 is lowered, switch arm 164 is moved out of contact with actuator 166—again providing a signal to the controller that the clutch 132 is now in spin mode. As such, washing machine 50 is provided with a mechanism for positively identifying the position of clutch 132.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a wash tub for the receipt of laundry articles and fluid for cleaning;

a wash basket received into the wash tub, the wash basket configured for retaining the laundry articles;

an agitator positioned in the wash basket, the agitator configured for imparting motion to the articles within the wash basket;

a motor for selectively rotating one or both of the agitator and the wash basket;

an agitator drive element connected to the agitator and driven by the rotation of the motor;

a wash basket drive element connected to the wash basket and configured for selective rotation by the motor;

a clutch configured for shifting movement along the agitator drive element so as to selectively position the clutch between i) an engaged position in which the clutch connects the motor and the wash basket drive element so that both the agitator and the wash basket are rotated by the motor, and ii) a disengaged position in which the clutch disconnects the motor and the wash basket drive element such that the agitator is rotated while the rotation of the wash basket is prevented;

a yoke configured for moving the clutch between the engaged position and the disengaged position;

a cam follower configured for rotation that moves the yoke;

a torsion spring, the cam follower connected with the yoke through the torsion spring, the torsion spring configured for biasing the position of the cam follower; and, a switch comprising an actuator that is activated by the shifting of the clutch between the engaged position and the disengaged position, the switch configured to provide a signal indicative of the movement of the clutch.

2. A washing machine appliance as in claim 1, wherein the switch further comprises an arm extending from the switch and positioned so that the arm of the switch is moved by the yoke as the clutch is shifted along the agitator drive element.

3. A washing machine appliance as in claim 2, wherein the arm depresses the actuator when the clutch is shifted from the engaged position to the disengaged position.

4. A washing machine appliance as in claim 1, further comprising a controller for receiving the signal from the switch.

5. A washing machine appliance as in claim 1, wherein said wash basket drive element is concentric with said agitator drive element.

6. A washing machine appliance as in claim 1, further comprising a cam that is rotatable about an axis, the cam forming an inclined surface that is curved around the axis; and wherein the cam follower is positioned in contact with the cam wherein the rotation of the cam causes the cam follower to rotate the yoke about a pivot point so as to shift the position of the clutch.

7. A washing machine appliance as in claim 6, wherein said motor further comprises a rotor, and wherein said clutch includes a plurality of teeth configured for engaging said rotor whenever the clutch is shifted into the engaged position.

8. A washing machine, comprising:

a wash basket;

an agitator positioned within the wash basket;

a motor that includes a stator and a rotor, a shaft extending from the motor and connected to the agitator;

a spin tube positioned around the shaft and connected to the wash basket;

a clutch positioned adjacent to the rotor, said clutch selectively shiftable between i) an engaged position where the rotor is operably connected with the spin tube so as to rotate the wash basket and the agitator when the motor is activated and ii) a disengaged position where the rotor is no longer connected with the spin tube when the motor is activated;

a yoke configured for moving the clutch between the engaged position and the disengaged position;

a cam follower configured for rotation that moves the yoke;

a torsion spring, the can follower connected with the yoke through the torsion spring, the torsion spring configured for biasing the position of the cam follower; and, a switch comprising an actuator and a switch arm that is positioned for contact with the yoke such that the actuator is depressed by the shifting of the clutch between the engaged position and the disengaged position, the switch configured to provide a signal indicative of the movement of the clutch.

9. A washing machine as in claim 8, wherein the yoke has a pivot point about which the yoke pivots to either lower the clutch into the engaged position or raise the clutch into the disengaged position;

wherein the actuator of the switch is connected with the yoke such that the movement of the yoke into the disengaged position depresses the actuator.

10. A washing machine as in claim 8, wherein the yoke has a pivot point about which the yoke pivots to either lower the clutch into the engaged position or raise the clutch into the disengaged position;

wherein the switch further comprises a leg connecting the actuator of the switch with the yoke such that the movement of the yoke into the disengaged position moves the leg to contact and depress the actuator.

11. A washing machine as in claim 10, further comprising:

a spring positioned above said clutch and configured for pressing the clutch towards the engaged position.

12. A washing machine as in claim 10, further comprising:

a rotatable cam having an inclined surface in contact with the cam follower, such that rotation of the cam pushes the cam follower so as to rotate the yoke about the pivot point.

13. A washing machine as in claim 8, further comprising:

a controller in communication with the switch and configured for receiving the signal from the switch.

14. A washing machine as in claim 8, wherein the yoke further comprises a finger positioned for contact with the switch arm as the clutch is moved between the engaged positioned and the disengaged position.

15. A washing machine, comprising:

a wash basket;

an agitator positioned within the wash basket;

a motor that includes a stator and a rotor, a shaft extending from the motor and connected to the agitator;

a spin tube positioned around the shaft and connected to the wash basket;

a clutch positioned adjacent to the rotor, said clutch selectively shiftable between i) an engaged position where the rotor is operably connected with the spin tube so as to rotate the wash basket and the agitator when the motor is activated and ii) a disengaged position where the rotor is no longer connected with the spin tube when the motor is activated;

a yoke configured for moving the clutch between the engaged position and the disengaged position, wherein the yoke has a pivot point about which the yoke pivots to either lower the clutch into the engaged position or raise the clutch into the disengaged position;

a cam follower configured for rotation that moves the yoke;

a torsion spring, the cam follower connected with the yoke through the torsion spring, the torsion spring configured for biasing the position of the earn follower;

a rotatable cam having an inclined surface curved along a direction of rotation of the cam and in contact with the cam follower such that rotation of the cam pushes the cam follower so to rotate the yoke about the pivot point; and a switch configured for contact with the yoke and comprising an actuator that is depressed by the shifting of the clutch between the engaged position and the disengaged position, the switch configured to provide a signal indicative of the movement of the clutch.

* * * * *